US011045020B2

(12) United States Patent
Amber, III et al.

(10) Patent No.: US 11,045,020 B2
(45) **Date of Patent: *Jun. 29, 2021**

(54) FRAME ASSEMBLY FOR DISPLAYING AN OBJECT AND METHOD OF MAKING THE SAME

(71) Applicant: Chameleon Displays LLC, West Deptford, NJ (US)

(72) Inventors: Edward Amber, III, West Deptford, NJ (US); Jonathan Degraff-Cipriani, West Deptford, NJ (US); Jessica Degraff-Amber, West Deptford, NJ (US)

(73) Assignee: CHAMELEON DISPLAYS LLC, West Deptford, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/409,283

(22) Filed: May 10, 2019

(65) Prior Publication Data

US 2019/0343302 A1 Nov. 14, 2019

Related U.S. Application Data

(60) Provisional application No. 62/669,700, filed on May 10, 2018.

(51) Int. Cl.

| | |
|---|---|
| ***A47G 1/06*** | (2006.01) |
| ***A47G 1/02*** | (2006.01) |
| ***A47G 1/12*** | (2006.01) |
| ***A47G 1/16*** | (2006.01) |
| ***A47G 1/14*** | (2006.01) |

(52) U.S. Cl.

CPC ..... *A47G 1/0622* (2013.01); *A47G 1/02* (2013.01); *A47G 1/12* (2013.01); *A47G 1/142* (2013.01); *A47G 1/162* (2013.01); *A47G 1/1666* (2013.01); *A47G 2001/0672* (2013.01); *A47G 2001/0694* (2013.01)

(58) Field of Classification Search

CPC ..... A47G 1/062; A47G 1/162; A47G 1/142; A47G 1/1666; A47G 2001/0694; A47G 2001/0672

USPC ..... 40/786, 761

See application file for complete search history.

(56) References Cited

U.S. PATENT DOCUMENTS 642,558 A * 1/1900 Oldenbusch ..... A47G 1/0633 40/786

868,627 A * 10/1907 Fairchild ..... A47G 1/0633 40/786

(Continued)

*Primary Examiner* — Kristina N Junge

(74) *Attorney, Agent, or Firm* — Finnegan, Henderson, Farabow, Garrett & Dunner, LLP

(57) ABSTRACT

A frame assembly for displaying an object is described. In an embodiment, the frame assembly comprises a printable, rigid material forming a rectangular shaped outer frame that defines an area in which the object, such as a photograph, is displayed. The outer frame is made of a rigid, multilayer substrate that has been machined with grooves that allows it to be manipulated to form front and side walls, such that an image can be printed or wrapped around the entire surface. A method of making the frame assembly is also described. The method comprises printing an image on the frame, such as by direct digital or screen printing prior to assembling the parts of the frame.

26 Claims, 13 Drawing Sheets

(56) References Cited

U.S. PATENT DOCUMENTS

| | | | | | |
|---|---|---|---|---|---|
| 3,649,398 | A * | 3/1972 | Keith | B32B 27/00 | 156/79 |
| 4,819,354 | A * | 4/1989 | Papov | A47G 1/141 | 248/459 |
| 4,975,137 | A * | 12/1990 | Cross | B43M 99/008 | 156/223 |
| 5,427,309 | A * | 6/1995 | Voss | B65D 5/4266 | 229/182 |
| 5,819,458 | A * | 10/1998 | Hadden | A47G 1/0605 | 40/782 |
| 6,056,840 | A * | 5/2000 | Mills | B29C 53/063 | 156/217 |
| 7,320,195 | B1 * | 1/2008 | Kushner | A47G 1/142 | 40/761 |
| 7,513,477 | B2 * | 4/2009 | Lampert | A47G 1/18 | 248/466 |
| 8,555,536 | B2 * | 10/2013 | Steichen | A47G 1/0633 | 40/786 |
| 8,959,812 | B2 * | 2/2015 | Ridless | A47G 1/141 | 40/603 |
| 2004/0231218 | A1 * | 11/2004 | Dominioni | A47F 3/001 | 40/800 |
| 2006/0196095 | A1 * | 9/2006 | Flannigan | A47G 1/0616 | 40/757 |
| 2012/0156402 | A1 * | 6/2012 | Domanski | B41M 5/502 | 428/32.18 |
| 2013/0160338 | A1 * | 6/2013 | Forbis | A47G 1/06 | 40/711 |
| 2016/0143461 | A1 * | 5/2016 | Millman | A47G 1/0633 | 40/786 |

* cited by examiner

FRAME ASSEMBLY FOR DISPLAYING AN OBJECT AND METHOD OF MAKING THE SAME

CROSS-REFERENCE TO RELATED APPLICATIONS

This application claims the benefit of priority to Provisional Applications 62/669,700, filed May 10, 2018, the entire contents of which are expressly incorporated herein by reference.

TECHNICAL FIELD

The present disclosure relates generally to a frame assembly, and more particularly to a frame assembly in which the front and side walls can be printed using a variety of techniques including digital or screen printing.

BACKGROUND

Traditional frames for holding photographs or other keepsakes are made from wood, metals, glass and various other materials that have inherent limitations. For example, a wooden frame can be susceptible to warping and moisture damage, a glass frame can be fragile and susceptible to breaking, while a metal frame can rust. Each of these inherent limitations make outdoor use or exposure to moisture and elements challenging. In addition, they are often heavy, which is problematic for certain applications that require the frame to be easily moved or transportable, such as point of purchase displays. Further, these traditional frames cannot be directly printed on all sides. They also cannot be folded to display an image and/or color in a 3-dimensional manner.

As a result, there is a need for a durable, light-weight frame assembly that is impervious to the elements and allows color and/or graphics to be displayed on the visible areas of the frame. There is also a need for a method of directly printing on the substrate used in the construction of the frame to eliminate additional processes and materials currently required to mount/laminate printed graphics on a thin substrate, which is subsequently attached to a traditional wood, plastic, or metal frame assembly.

The disclosed frame assembly and method of making it are directed to overcoming one or more of the problems set forth above and/or other problems of the prior art.

SUMMARY

In an embodiment, there is disclosed a frame assembly for displaying an object, comprising: a printable, rigid material forming an outer frame that defines an area in which the object is displayed. In this embodiment, the outer frame comprises two or more sides that are fixed to each other, wherein each side is made of a contiguous piece of the printable rigid material having a front surface (f) and a back surface (b) opposite the front surface, wherein the back surface (b) has a first groove (g1) that permits the areas of the rigid material on each side of the first groove (g1) to fold from 85° to 95°, such as 90° relative to each other to create a right angle for forming an outer side edge (e).

In the described embodiment, the back surface (b) further comprises a second groove (g2) and a third groove (g3) that are adjacent to each other and located at a distance (d) from the first groove (g1), wherein the second groove (g2) and third groove (g3) permit the contiguous piece of printable rigid material to fold 180 degrees such that the back surface (b) of the rigid material adjacent the second groove (g2) comes into contact with the rigid material adjacent the third groove (g3) to form an interior surface (i) of the outer frame assembly.

In another embodiment, there is disclosed a method of making a frame assembly, the method comprising: providing a contiguous piece of printable, rigid material having a front surface (f) and a back surface (b) opposite the front surface; forming one side of the frame assembly by machining multiple grooves into the back surface (b).

In this embodiment, the machining provides: a first groove (g1) that permits the areas of the rigid material on each side of the groove (g1) to fold 90 degrees relative to each other to create a right angle and forming an outer side edge (e), two adjacent grooves (g2 and g3) located at a distance (d) from groove (g1), wherein grooves g2 and g3 permit the contiguous piece of printable rigid material to fold 180 degrees such that backside of the printable rigid material on each side of g2 and g3 come into contact with each other to form an interior surface (i) of the outer frame assembly;

The method described in this embodiment further comprises repeating the forming steps to produce multiple sides of the frame and fastening the multiple sides of the frame to produce an outer frame that defines an area in which the object is displayed.

BRIEF DESCRIPTION OF THE DRAWINGS

The accompanying drawings, which are incorporated in and constitute a part of this specification, illustrate disclosed embodiments and, together with the description, serve to explain the disclosed embodiments. In the drawings:

FIG. 12A shows an easel stand inserted. FIG. 12B shows the easel stand stored in the back of the frame.

It is to be understood that both the foregoing general description and the following detailed description are exemplary and explanatory only and are not restrictive of the invention, as claimed.

DETAILED DESCRIPTION OF THE INVENTION

There is disclosed a frame assembly for displaying an object, comprising: a printable, rigid material forming an outer frame that defines an area in which the object is displayed, wherein the outer frame comprises two or more sides that are fixed to each other.

As used herein, "printable" is intended to mean a surface on which an image can be directly print thereon, such that the image can be wrapped around the frame. It can provide a multi-dimensional look.

As used herein, a "rigid material" includes a sturdy, lightweight plastic, such as a recycled plastic. In one embodiment, the rigid material is both fire and water-resistant. One non-limiting example of such a material is polyvinylchloride (PVC).

Figure 1A:
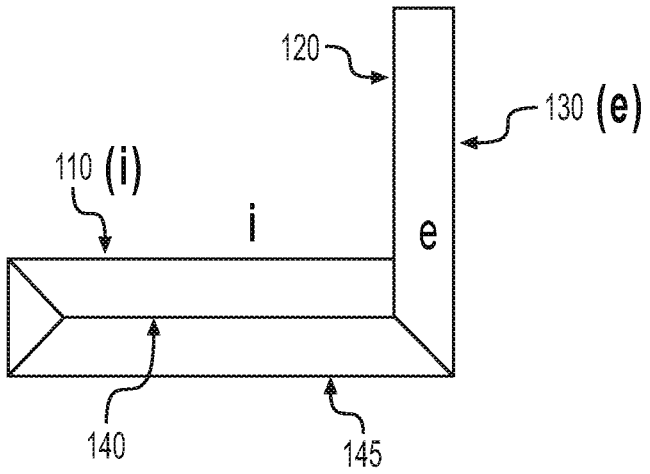
FIG. 1A is top view of the printable, rigid material that is folded to form adjacent sides of a frame according to the present disclosure.

A more detailed description of the body of the frame assembly is provided in the FIGS. 1-13. Specifically referring to FIGS. 1A-1E, a frame assembly is shown, and represents an example of an embodiment according to the present disclosure. FIG. 1A shows the unique configuration of each side of the frame and how it can be made from a contiguous piece of rigid material. The contiguous material is used to form one side of a frame by bending an otherwise unbendable (i.e., rigid) material by cutting grooves in the back surface. Specifically, by machining grooves into the back surface of the rigid material, the sides can be folded to add integrity to the overall structure. For example, FIG. 1A shows Interior surface (i) 110, the Back Surface (b) 120, Outer Side Edge (e) 130.

Figure 1B:
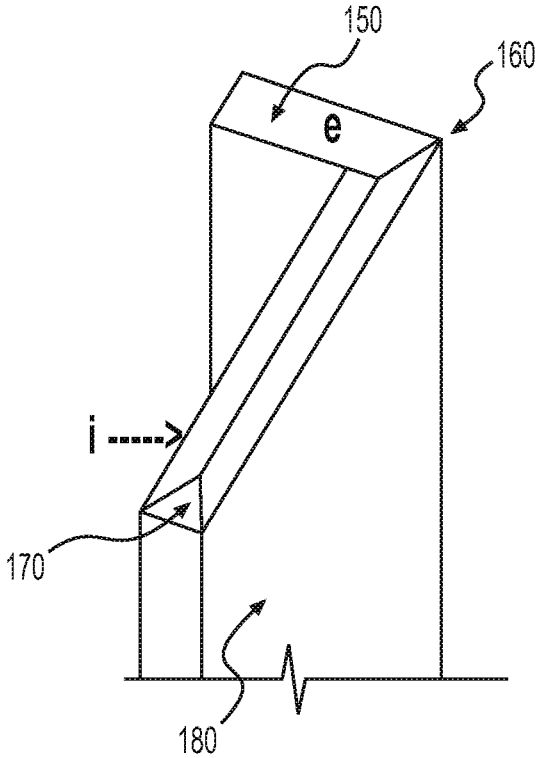
FIG. 1B is a fragmentary side view of the frame of FIG. 1A.

FIG. 1B is a top perspective showing the Outer Side Edge (e) 150 and the 90° angle 160 formed from groove g1. This Figure also shows how grooves g2 and g3 170 allow the back surfaces on each side of g2 and g3 to touch.

Figure 1E:
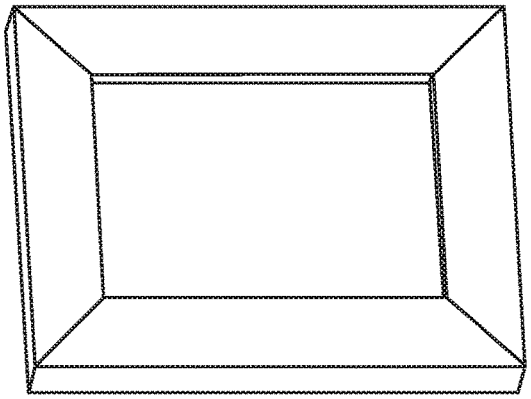
FIG. 1E is the frame of FIG. 1D with all sides connected.
Figure 1D:
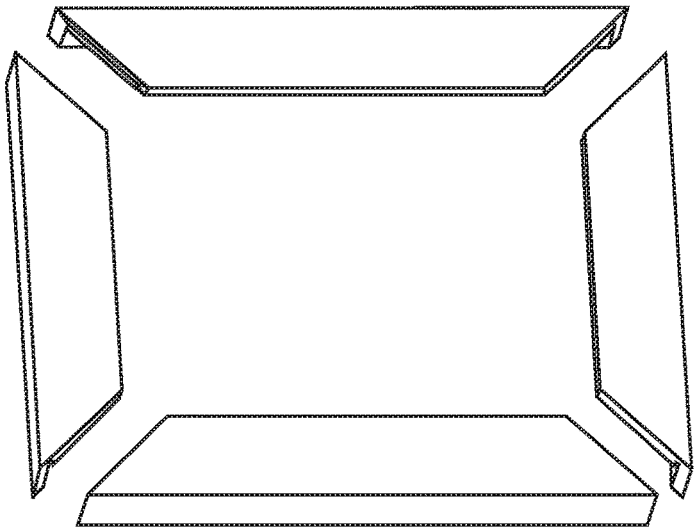
FIG. 1D is an exploded view of a frame according to the present disclosure.
Figure 1C:
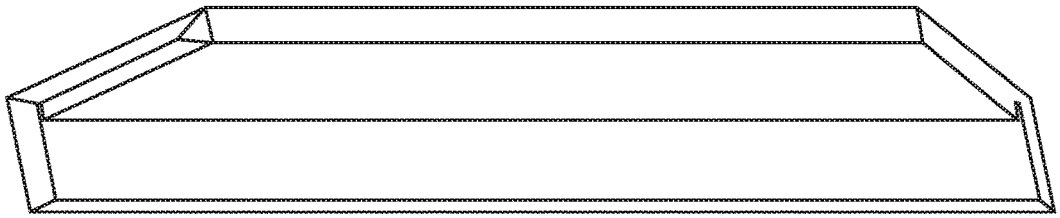
FIG. 1C is another fragmentary side view of the frame of FIG. 1A.

To add integrity to the finished frame by keeping the walls of the frame folded in a desired configuration, such as shown in FIGS. 1A and 1B, a glue or chemical welding technique can be used. In one embodiment, the gluing method comprising hot gluing at 253° F. using a commercially available glue, such as Infinity SuperTac™ 500. This method comprises depositing glue or a chemical welding solvent at the bend points or on the flat surfaces that touch an adjacent surface. Non-limiting examples of the chemical welding solvents that can be applied using an applicator include Weld-On™ 2007 Series/Weld-On™ 66 Series. FIG. 1C is a fragmentary side view of the frame of FIG. 1A. FIG. 1D is an exploded view of a frame according to the present disclosure. FIG. 1E is the frame of FIG. 1D with all sides connected.

Figure 2:
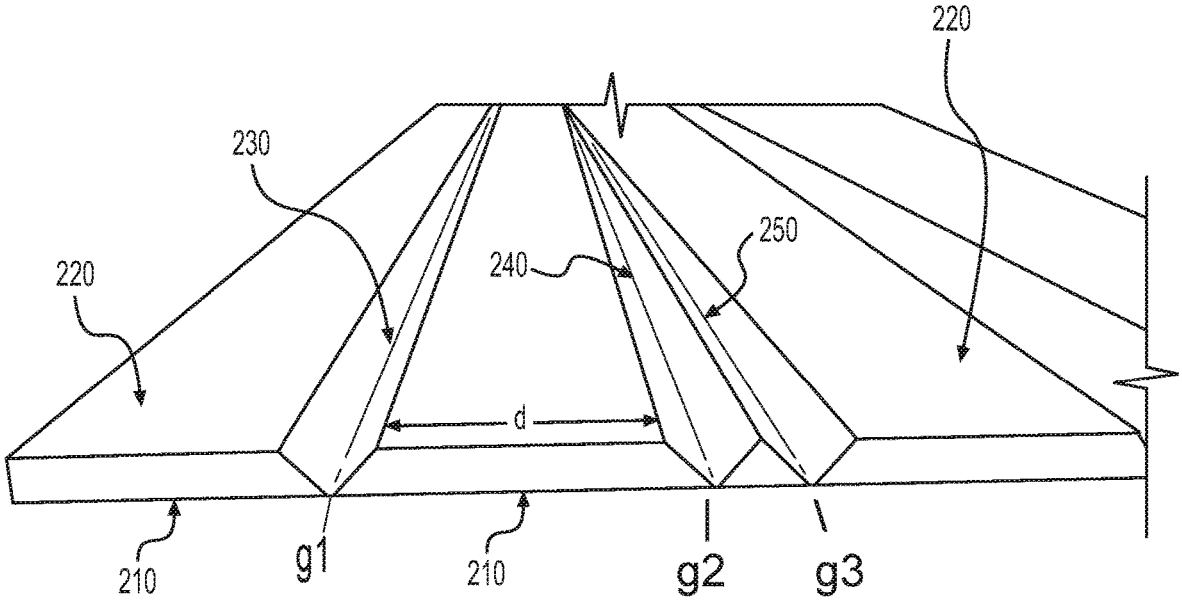
FIG. 2 is a side perspective of the printable, rigid material with the locations of the various v-shaped grooves in the back surface prior to forming the contiguous material into one side for the outer frame described herein.

An expanded view of intermediate product of the flattened out rigid material is provided in FIG. 2. Here, it shows that each side of the described frame is made of a contiguous piece of the printable rigid material having a front surface (f) 210 and a back surface (b) 220 opposite the front surface 210, wherein the back surface (b) 220 has a first groove (g1) 230 that permits the areas of the rigid material on each side of the first groove (g1) 230 to fold from 85° to 95°, such as 90° relative to each other to create a right angle for forming an outer side edge (e).

FIG. 2 further shows the back surface (b) 220 as further comprising a second groove (g2) 240 and a third groove (g3) 250 that are adjacent to each other and located at a distance (d) from the first groove (g1) 230, wherein the second groove (g2) 240 and third groove (g3) 250 permit the contiguous piece of printable rigid material to fold 180 degrees such that the back surface (b) 220 of the rigid material adjacent the second groove (g2) 240 comes into contact with the rigid material adjacent the third groove (g3) 250 to form an interior surface (i) of the outer frame assembly.

In an embodiment, the distance (d) defines the width of one side of the frame assembly. See, for example, FIG. 1B (180) and FIG. 2, which further shows an embodiment in which grooves g1, g2, and g3 having a v-shape with an angle ranging from 80° to 95°. In a broader embodiment, the groove may have an angle ranging from 43° to 92°, relative to the front surface of the printable rigid material, such as from 45° to 90°, relative to the front surface of the printable rigid material. The actual angle is dependent on the amount of bend necessary to achieve the desired shape. Similarly, the miter angle can be changed to provide a final frame shape that is not rectangular.

In one embodiment, a 5 mm groove was routed to shape using a 90° or 91° V-Groove bit. This embodiment is described for a PVC containing material having a thickness of about 5 mm. However, the PVC containing material can have a thickness ranging from 2 mm to 6 mm, such as from 3 mm to 5 mm.

In order to be used in settings not typically used by most frames, such as outdoor displays that are exposed to weather, the frame assembly described herein comprises a printable, rigid material that is resistant to chemicals, corrosion, fire and moisture. In one embodiment, the frame material may comprise a thermo-plastic material, such as a polyvinyl chloride (PVC). With reference to FIG. 2, in an embodiment, the polyvinyl chloride (PVC) may be in the form of a multilayer material having two smooth, rigid surfaces with a foamed PVC layer in between. In this embodiment, both the front and back surfaces comprise a smooth, rigid PVC layer.

Figure 3:
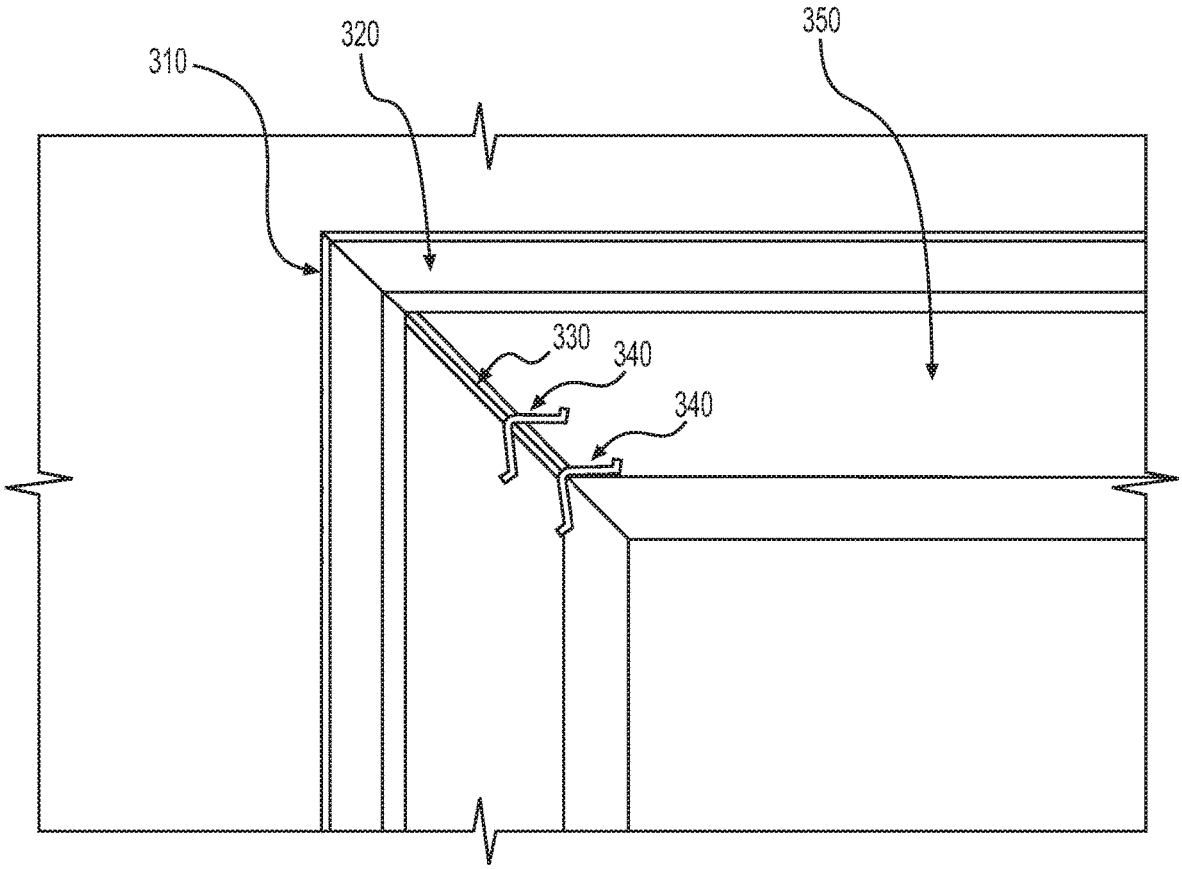
FIG. 3 is a perspective of the back side of a frame assembly according to the present disclosure showing an embodiment in which a v-nail can attach two sides on the underside of a frame prior to the backer being glued onto it.

In an embodiment, the outer frame comprises two or more sides attached to each other by at least one nail, screw, adhesive or combinations thereof. For example, in an embodiment shown in FIG. 3, the at least one nail is v-shaped (340). With further reference to FIG. 3, in an embodiment, the back surface does not have the smooth, rigid layer. Thus, the foamed PVC layer forms the back surface (320) and the front side comprises a smooth, hard PVC layer (310). In addition, FIG. 3 shows the back surface of one corner with two sides that are mitered at a 45° angle 330 to provide a right edge to form a desired rectangular shape. See also FIGS. 1D and 1E and 9A-9D, which show the outer frame of the frame assembly comprising four sides that are fixed to each other and form a rectangular shape.

There is also disclosed herein a shadowbox that is integrally attached to the disclosed frame assembly. As used herein, a "shadowbox" refers to an enclosed glass-front display case containing an object or objects. The objects within a shadowbox are typically grouped with a general theme or concept. For example, a shadowbox may contain action figures or movie characters from a particular movie, athlete for a particular team, and the like, or any object of particular significance to the person using the shadowbox. It is understood by one-skilled in the art that the grouping of the objects and the depth effect created by their relative heights from the backing creates a dramatic visual result.

The shadowbox described herein can be made using the same materials and procedures described herein. For example, the materials comprise a PVC the back of which has been machined to provide grooves that allow the sides to fold as previously described. One difference between the frame assembly and the shadowbox is in the size of the edge. The side edge of a shadow box is larger than the frame in order to provide sufficient space for displaying the object within the shadowbox. See FIG. 4 at 460.

Figure 4:
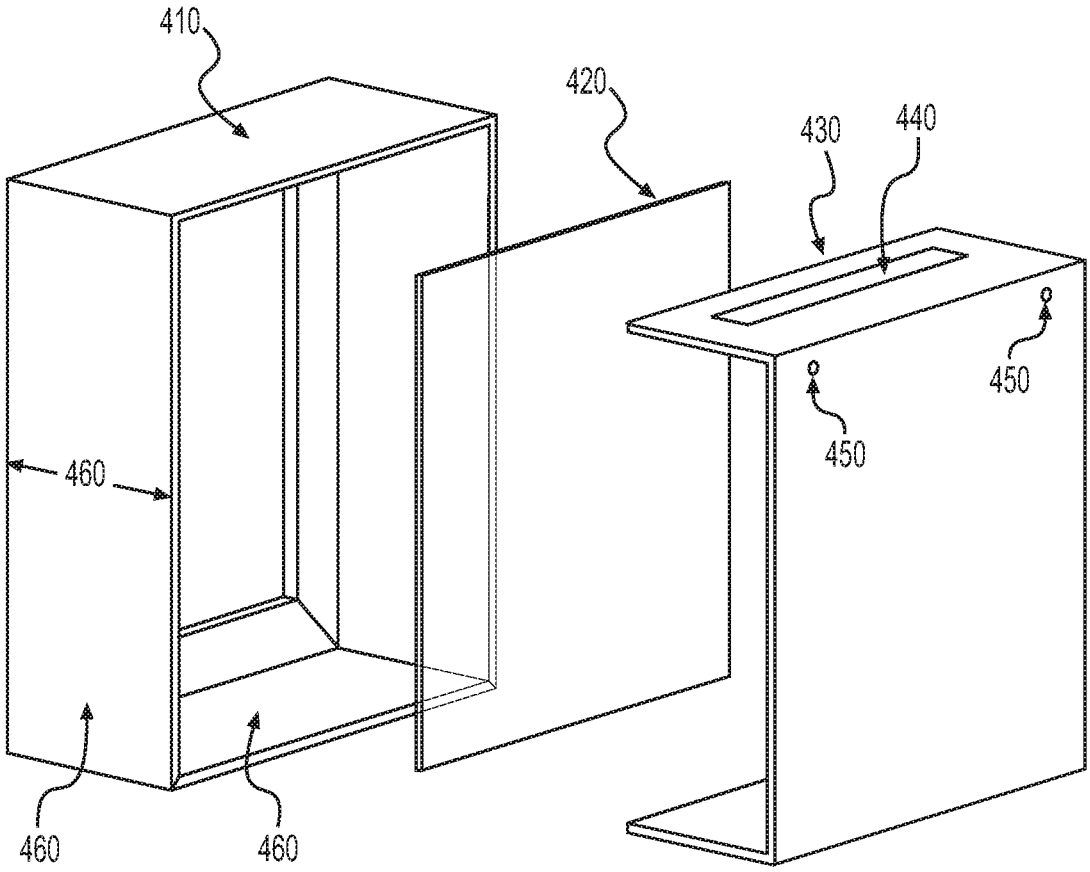
FIG. 4 is an exploded view of the various parts of a shadow box assembly according to the present disclosure.

FIG. 4 further shows the frame assembly described herein with a shadowbox integrally connected to the frame assembly. The disclosed a shadowbox may further comprise a back panel 430 removably attached to the shadowbox 410. In one embodiment, the shadow box further includes a transparent or translucent material located between the frame assembly and the back panel, wherein the transparent or translucent material comprises a glass or plastic plate 420. In an embodiment, either the shadowbox or the back panel may include a light for illuminating the object displayed in the frame. See FIG. 5A at 520.

Figure 5A:
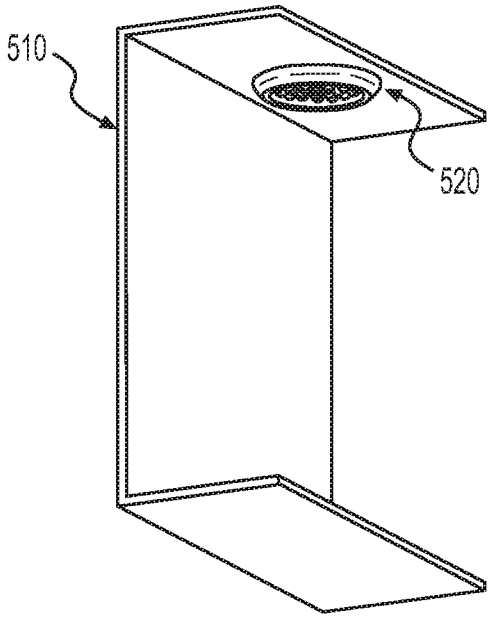
FIG. 5A is a perspective of one part that can be used in the shadow box of FIG. 4 comprising an LED light.
Figure 5B:
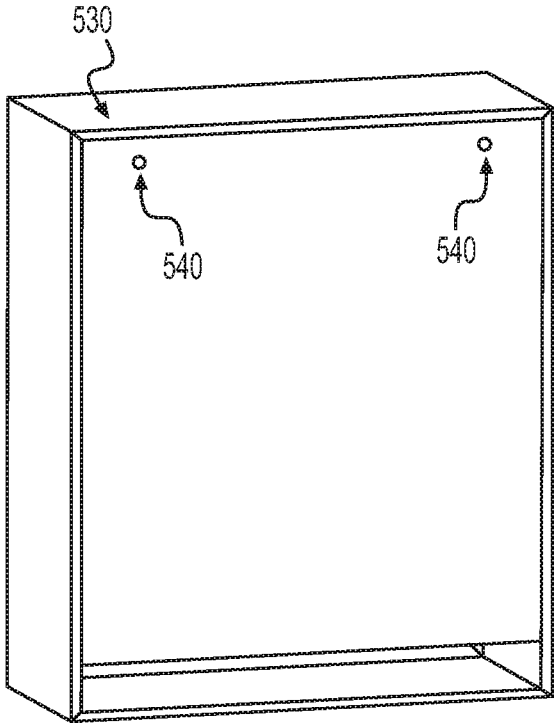
FIG. 5B is a perspective of the back side of the shadow box according to the present disclosure.

In various embodiments, and with reference to FIG. 5B, the back panel removably attached to the shadowbox may further include one or more wall mounting holes 540 for mounting the frame assembly and the shadowbox to a wall. The back panel may also include a magnetic strip for securing the back panel to the frame assembly. See FIG. 4 at 440.

The frame assembly alone, or both the frame assembly and the attached shadow box, may include a printed image. The printed image can be tailored to be consistent with the object being displayed in the frame assembly. For example, if action figures are displayed in the shadowbox, an image of the movie starring the action figures can be printed in the frame. Similarly, if an athlete is displayed in the frame assembly, the logo of the team on which the athlete plays can be printed on the surrounding frame. In addition, the printed image may further comprise at least one UV ink or UV clear coat.

There is also disclosed a method of making a frame assembly and the shadowbox as described herein. For example, in an embodiment, the method comprises: providing a contiguous piece of printable, rigid material having a front surface (f) and a back surface (b) opposite the front surface; forming one side of the frame assembly by machining multiple grooves into the back surface (b), wherein said machining provides: a first groove (g1) that permits the areas of the rigid material on each side of the groove (g1) to fold 90 degrees relative to each other to create a right angle and forming an outer side edge (e), two adjacent grooves (g2 and g3) located at a distance (d) from groove (g1), wherein grooves g2 and g3 permit the contiguous piece of printable rigid material to fold 180 degrees such that backside of the printable rigid material on each side of g2 and g3 come into contact with each other to form an interior surface (i) of the outer frame assembly.

In this embodiment, the forming steps described above are repeated to produce multiple sides of the frame, such as four sides to produce a rectangular shaped frame, which is followed by fastening the multiple sides of the frame to produce an outer frame that defines an area in which the object is displayed.

In one embodiment, adhering the backside of the printable rigid material on each side of g2 and g3 that come into contact with each other is done by depositing an adhesive or using a chemical welding technique.

As previously described, fastening the sides of the outer frame comprises mitering each side at an angle sufficient to give the desired shape (FIG. 3 at 330), followed by attaching each side with at least one screw, nail, or an adhesive. In an embodiment, the outer frame comprises two or more sides attached to each other by at least one nail, screw, adhesive or combinations thereof. For example, in an embodiment shown in FIG. 3, the at least one nail is v-shaped (340).

In an embodiment, the outer frame comprises four side, and each side is mitered at an angle of 45 degrees to give the outer frame a rectangular shape. See FIG. 3 at 330.

The method described herein may further comprise printing an image on the front and/or side walls by digital printing or screen printing.

Figure 6:
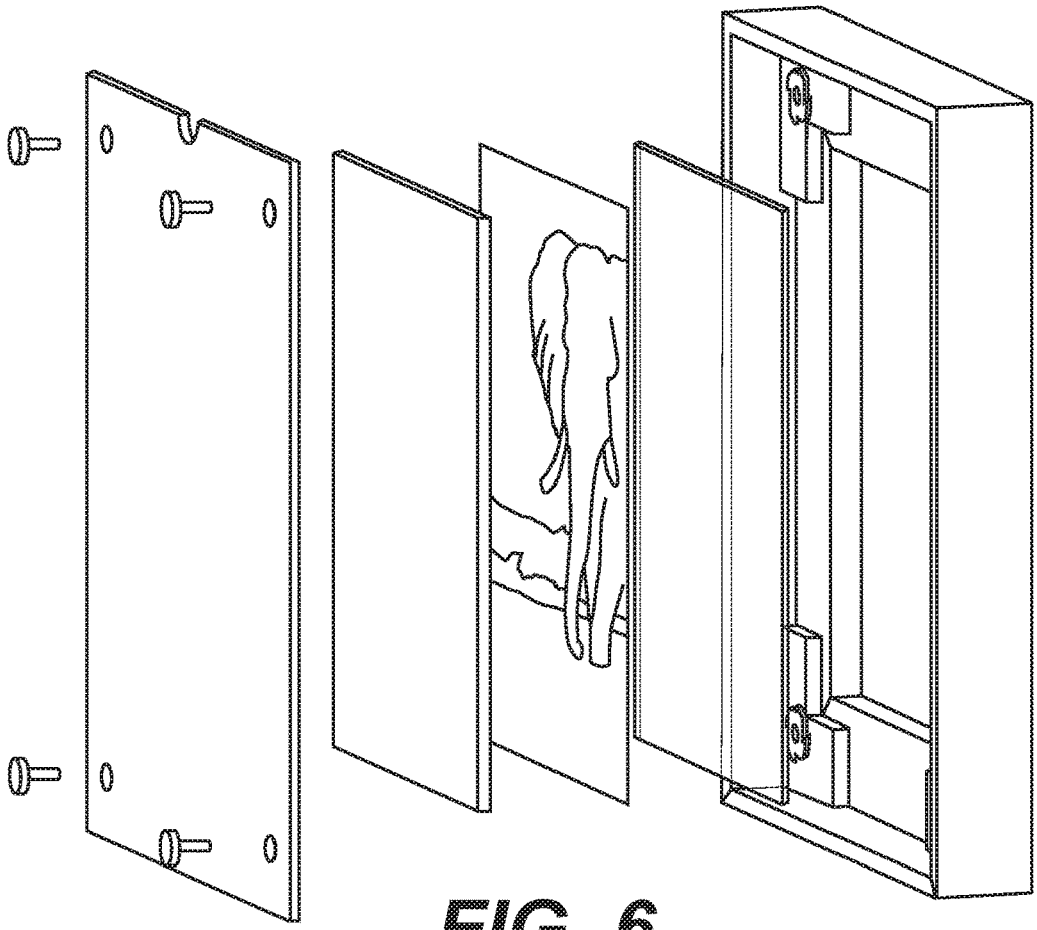
FIG. 6 is an exploded view of the various parts of a frame assembly according to the present disclosure.
Figure 9A:
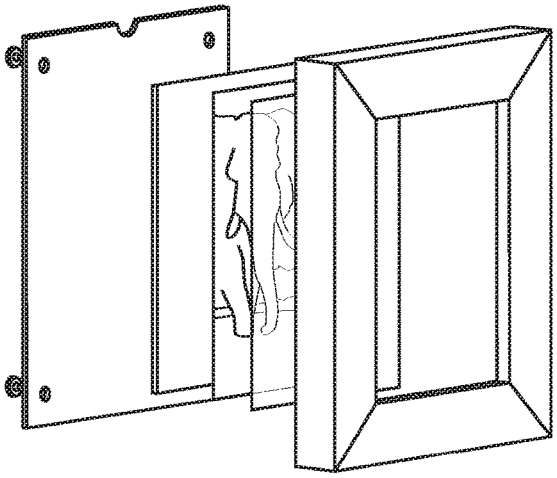
FIG. 9A is an exploded view of the various parts of a frame assembly according to the present disclosure.
Figure 9B:
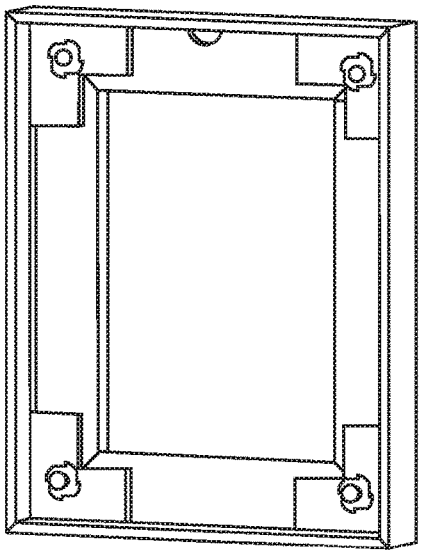
FIG. 9B is the backside of the assembly of FIG. 9A, without a first or second back panel with the brackets exposed.
Figure 9C:
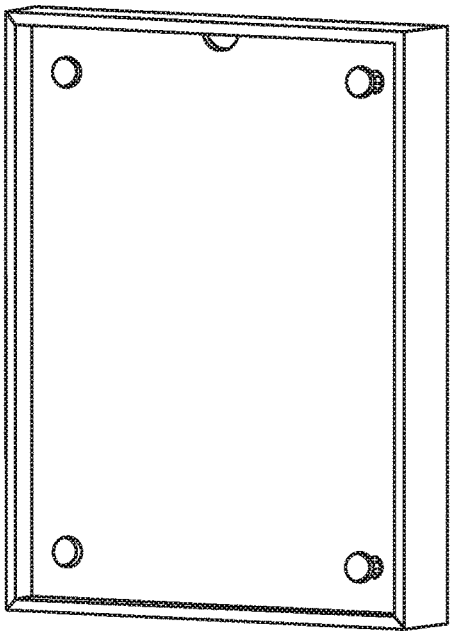
FIG. 9C is the backside of the assembly of FIG. 9C, showing the second back panel.
Figure 9D:
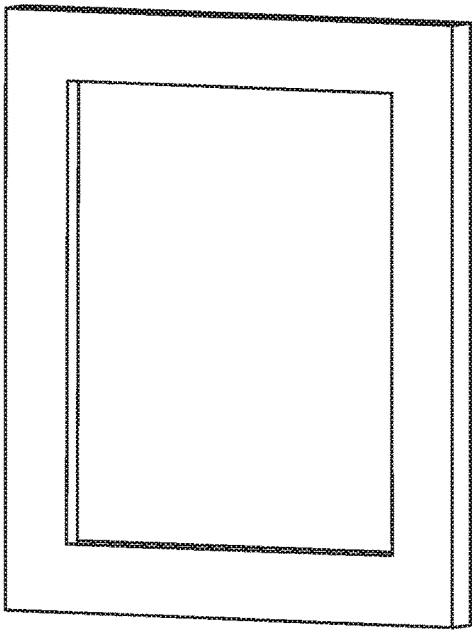
FIG. 9D is the front side of the frame, showing it printed with a sports team logo.

In one embodiment the frame assembly described herein further comprises an outer back panel that is removably attached to the outer frame. This embodiment may further comprise an inner back panel located between the outer frame and the outer back panel. Various forms of these embodiments are shown in FIGS. 6 and 9A. These removably attached outer back panel may be attached by a screw that can be hand-tightened. In addition, the frame assembly described herein may further comprise a transparent or translucent material located between the outer frame and the inner back panel, wherein the transparent or translucent material comprises a glass or plastic plate. This material is shown in FIGS. 6 and 9A. FIG. 9A is an exploded view of the various parts of a frame assembly according to the present disclosure. FIG. 9B is the backside of the assembly of FIG. 9A, without a first or second back panel with the brackets exposed. FIG. 9C is the backside of the assembly of FIG. 9C, showing the second back panel. FIG. 9D is the front side of the frame, showing it printed with a sports team logo.

Figure 10:
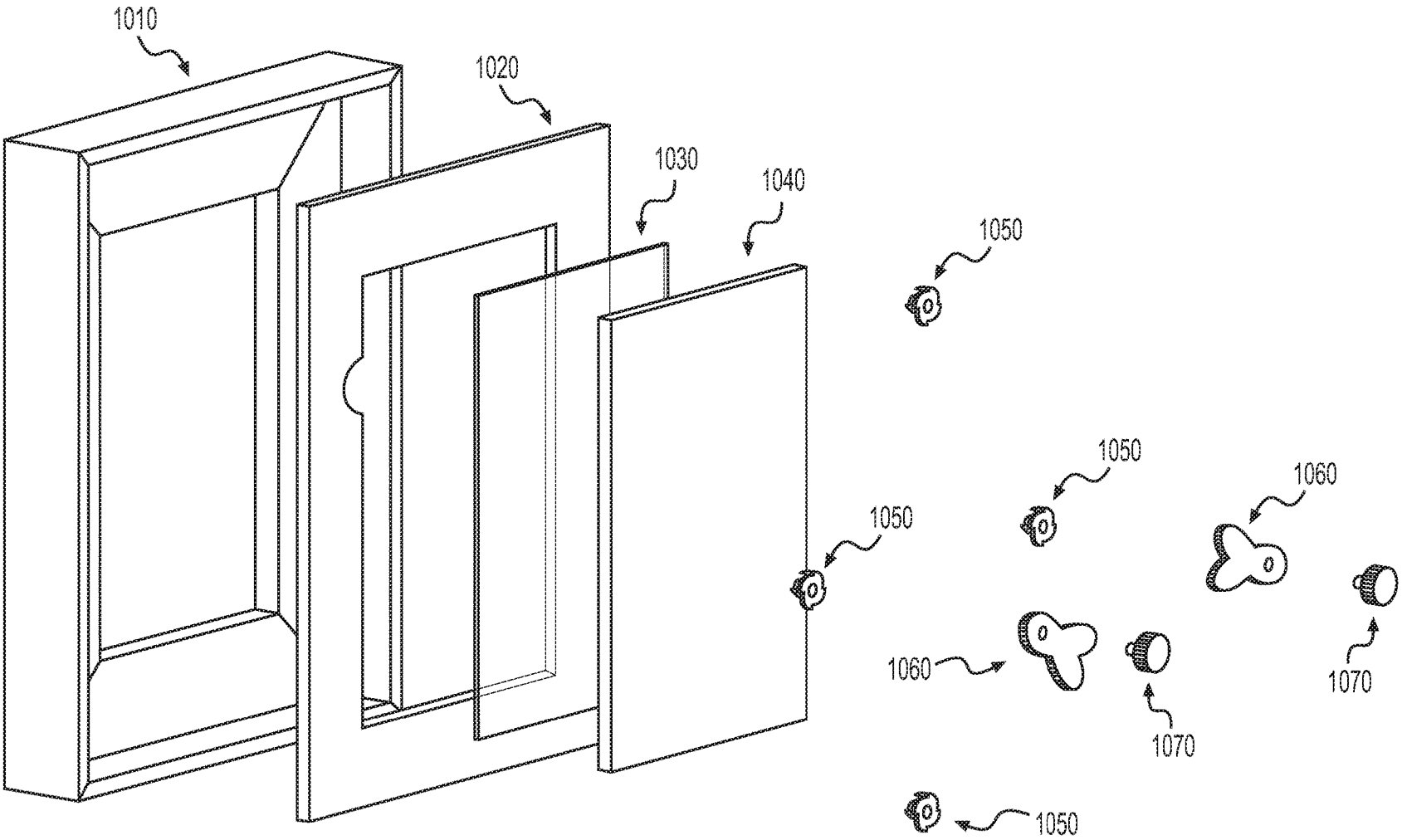
FIG. 10 is an exploded view of the various parts of a frame assembly according to the present disclosure including an assembled frame, a die cut insert the backside of the assembly, a clear plate (glazing), and a backing for holding in the glazing. Various methods of holding the frame assembly in place including T-nuts, turn buttons and thumb screws are also shown.

In one embodiment, there is disclosed an assembled frame, as described herein. Reference is made to FIG. 10, which shows an exploded view of the various parts of a frame assembly according to the present disclosure including an assembled frame 1010, a die cut insert located on the backside of the assembly 1020, a clear plate (glazing), 1030, which can be a plastic plate or a glass plate, and a backing for holding in the glazing 1040. FIG. 10 further illustrates various fasteners for holding the frame assembly in place. For example, in one embodiment the methods include T-nuts 1050, turn buttons 1060 and thumb screws 1070.

Figure 11:
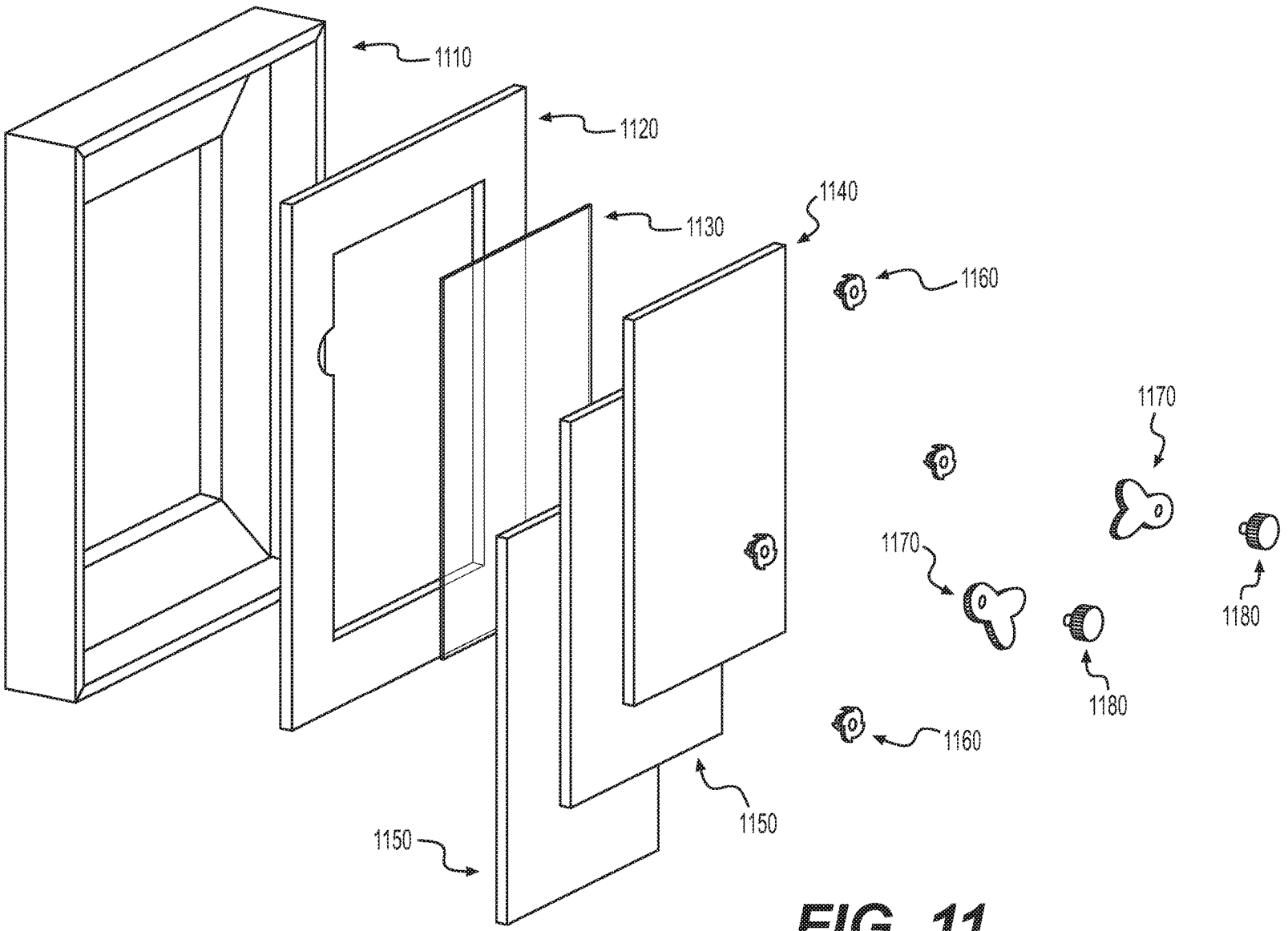
FIG. 11 is an additional embodiment of FIG. 10, further showing various inserts that can be included in addition to or instead of the glazing. These inserts include a mirror, chalk board or dry erase whiteboard.

With reference to FIG. 11, in another embodiment, there is disclosed an assembled frame 1110, a die cut insert located on the backside of the assembly 1120, a clear plate (glazing), 1130, which can be a plastic plate or a glass plate, and a backing for holding in the glazing 1140. In this embodiment, the frame assembly further includes a mirror, chalkboard or dry erase white board 1150 in addition to or instead of the glazing. Similar to FIG. 10, FIG. 11 further illustrates various fasteners for holding the frame assembly in place, including T-nuts 1160, turn buttons 1170 and thumb screws 1180, and combinations thereof.

Figure 12B:
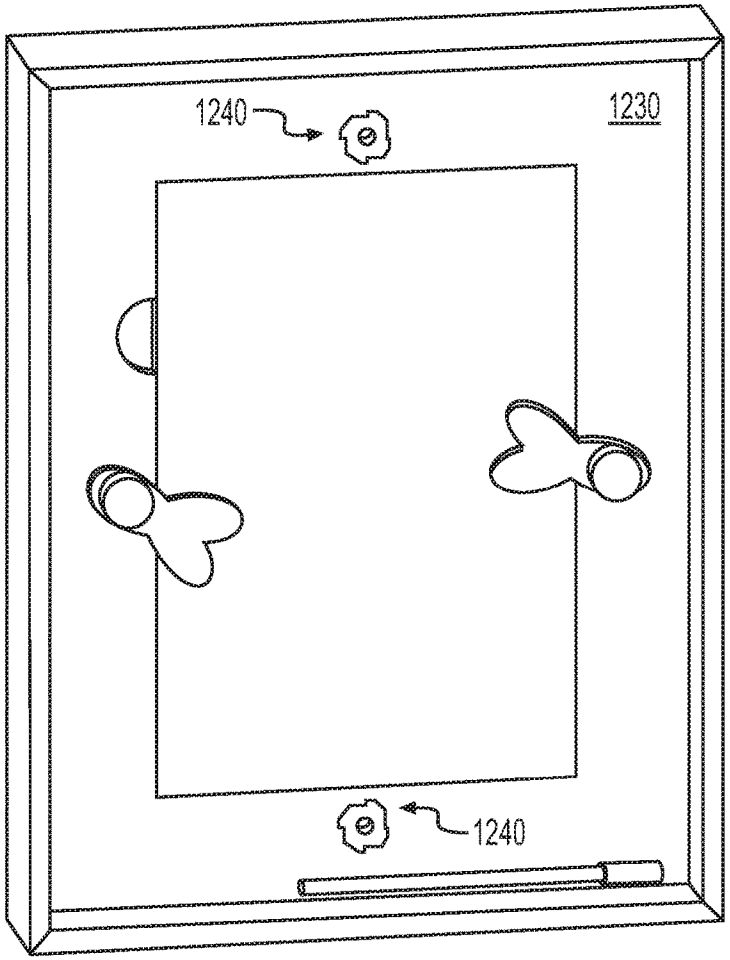
FIGS. 12A and 12B are side and back perspectives of embodiments according to the present disclosure showing a fully assembled frame of FIG. 10 or 11.
Figure 12A:
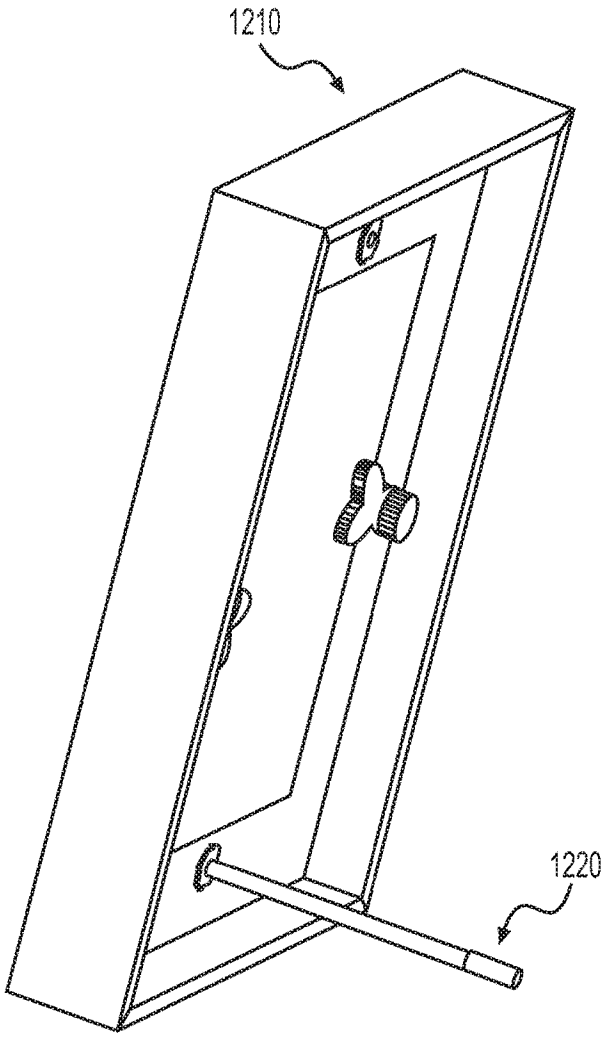

FIGS. 12A and 12B are side and back perspectives of embodiments according to the present disclosure showing a fully assembled frame 1210, such as those shown in FIG. 10 or 11. FIG. 12A shows a pin or peg that is inserted into a T-nut to form an easel stand 1220. While this figure shows the pin or peg with a threaded end that can be screwed into the T-nut, a threaded end is not necessary. Rather, a peg can be inserted and held into place by friction.

This easel stand allows the frame assembly to stand upright to display an object without being attached to a wall. In this embodiment, the easel stand 1220 includes a threaded post that can be screwed into a nut attached to the die cut insert 1230 that is attached to the frame, such as a T-nut 1240. FIG. 12B shows the easel stand stored in the back of the frame 1250.

Figure 13:
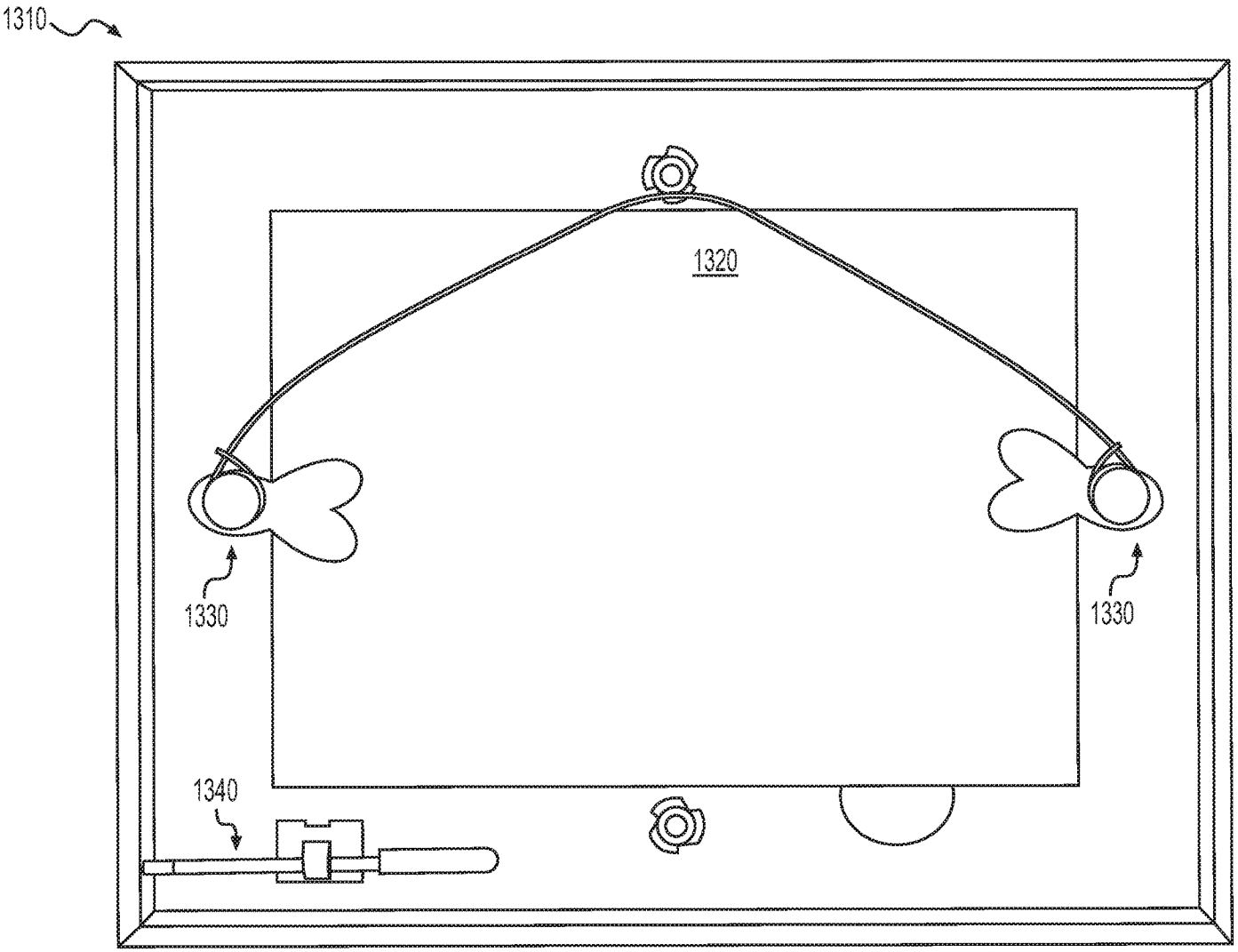
FIG. 13 is the back view of the frame assembly according to the present disclosure showing the assembled frame, with a wire hanger attached to thumb screws.

FIG. 13 is the back view of the frame assembly according to the present disclosure showing the assembled frame 1310, with a wire hanger 1320 attached to thumb screws 1330. This figure further shows the easel stand stored in the back of the frame 1340.

There is disclosed various methods for hanging the assembled frame from a substantially vertical surface, such as a wall or refrigerator. In an embodiment, the thumb screw includes a magnetic member, such as a magnetic head, for removable attaching the frame assembly to a magnetic surface. In another embodiment, the frame assembly comprises two thumb screws and a wire attached to the thumb screws for hanging the frame assembly, such as to a wall.

Figure 7:
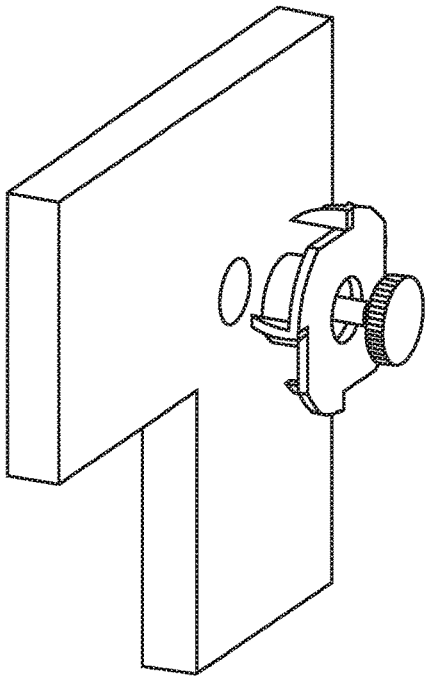
FIG. 7 is a schematic of a corner bracket that can be used in the frame assembly according to the present disclosure.

The above embodiments describe a frame assembly for displaying an object which includes one or more material, panel or layer that has been die cut to specifically fit within the outer frame. For example, the one or more material may comprise a transparent or translucent material, such as a glass or plastic plate located between the rectangular shaped outer frame and the first back panel. In other embodiment described herein, the frame assembly comprises a transparent or translucent material that is held in a fixed position by brackets. For example, FIGS. 7 and 9B show brackets that are die cut to an "L" shape, the transparent material may be held in a fixed position in at least two dimensions, such as in the x and y directions.

In addition to the benefit associated with the printable, rigid material that forms the rectangular shaped outer frame that defines an area in which the object is displayed, the present disclosure improves the way in which the contents displayed in the frame are secured. In an embodiment, the contents displayed in the frame are secured using screws and a backer, screws and turn buttons or other method in combination with the corner braces. The disclosed mounting hardware is unique in that it can simultaneously secure the frame, pictures and backer.

The printable, rigid material, the brackets, or both are made of a multilayer substrate. In an embodiment, the multilayer substrate may comprise a polyvinyl chloride (PVC) containing material, such as one comprising a foamed PVC inner layer located between two smooth, hard PVC layers.

It was previously described to use a glue or chemical welding technique for keeping the walls of the frame folded in a desired configuration. The same adhesive techniques can be used to attach brackets to the rectangular shaped outer frame. Namely, a gluing method comprising hot gluing at 253° F. using a commercially available glue, such as Infinity SuperTac™ 500 can be used to permanently attach areas of the frame assembly that a nail or screw is not desired. This method comprises depositing glue or a chemical welding solvent at the bend points or on the flat surfaces that touch an adjacent surface. Non-limiting examples of the chemical welding solvents that can be applied using an applicator include Weld-On™ 2007 Series/Weld-On™ 66 Series.

Figure 8:
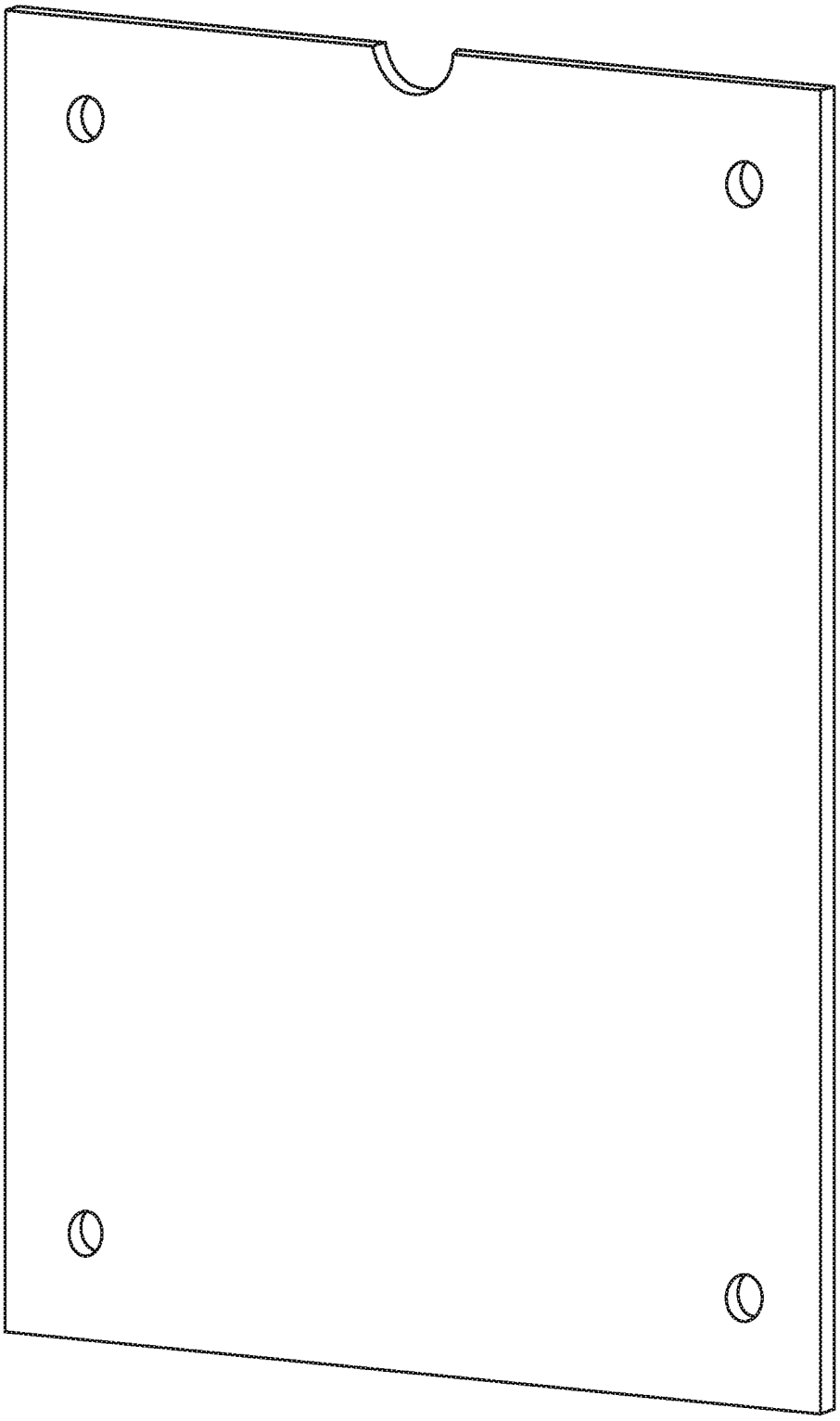
FIG. 8 is a schematic of a second back panel that can be used in the frame assembly according to the present disclosure.

The same adhesive techniques described above can be used to attach brackets to the rectangular shaped outer frame. Other attachment techniques include a screw or nut. In an embodiment, the outer back panel may be configured such that it is attached to the rectangular shaped outer frame using the same screw or nut associated with the brackets. To do this, the outer back panel comprises a hole or holes that are aligned with the screw or nut of the brackets. This allows the screw or nut to simultaneously secure the brackets and the outer back panel. As shown in FIG. 8, while not required, the outer back panel may further comprise at least one notch that assists in the removal of the inner back panel (when present) and outer back panel, such as by providing an area to grasp.

As described, the frame assembly and shadowbox comprise an outer frame that is made of a material on which standard printing techniques, such as by digital printing or screen printing, can be used to form an image. Thus, in an embodiment, the frame comprises a printed image that contains at least one UV ink or UV clear coat. The ability to deposit at least one UV ink or UV clear coat coating directly on the exposed frame (rather than on a separate substrate that is then laminated onto the frame) allows a lightweight, preferably recycled material that is durable, moisture resistant and warp resistant. The Inventors have discovered that in order to impart these beneficial characteristics and protect the visible or exposed parts of frame, the disclosed printing method provide a UV stabilized coating on the surface of the frame.

In one aspect, the present disclosure is directed to a frame assembly or shadowbox for displaying an object. The disclosed frame assembly comprises a printable, rigid material forming a rectangular shaped outer frame that defines an area in which the object is displayed. For example, the printable rigid material can comprise a multilayer substrate, such as a PVC foam sandwiched between rigid, smooth surfaces to have an outer frame with a front and back surface. This printable, rigid material is configured to bend, such as by having a V-shaped groove on the back surface that allows the material to bend to form both front and side walls of the outer frame. In an embodiment, the frame assembly comprises brackets located on each corner of the back surface of the rectangular shaped outer frame.

In an embodiment, the assembly further comprises one or more back panels, such as an inner back panel and an outer back panel. In an embodiment, only the outer back panel is required, and the inner back panel is not required. When the assembly does comprise an inner back panel, it should be in plane with the brackets, which allows the inner back panel to hold the object to be displayed in a fixed position. In this embodiment, the outer back panel is larger than the inner back panel and located over the inner back panel, where the outer back panel is removably attached to the brackets, such as by a screw or nut.

There is also disclosed a method of making the frame assembly and shadow box described herein. In an embodiment, the method comprises providing a printable, rigid material having a front and a back surface; machining at least one V-shaped groove into the back surface of the printable, rigid material; forming one side of a frame by bending the printable, rigid material at the V-shaped groove to form the frame having a front face and a sidewall; and repeating the forming step to produce four sides of the frame. In an embodiment, the four sides of the frame are attached to each other to produce a rectangular shaped outer frame that defines an area in which the object is displayed. In an embodiment, fastening occurs by positioning a bracket on each corner of the rectangular shaped outer frame, such as by gluing, chemical welding, or a magnet.

INDUSTRIAL APPLICABILITY

The disclosed frame assembly, and a method of making it may be applicable to an individual's use of a frame or shadowbox, or a more commercial use, such as a point of purchase display in a commercial setting. Whether individual or commercial, the disclosed assembly can be exposed to elements and thus used in outdoor environments.

Other embodiments of the invention will be apparent to those skilled in the art from consideration of the specification and practice of the invention disclosed herein. It is intended that the specification and examples be considered as exemplary only, with the true scope of the invention being indicated by the following claims.

What is claimed is:

1. A frame assembly for displaying an object, comprising:

a printable, rigid, thermo-plastic material forming an outer frame that defines an area in which said object is displayed, wherein the outer frame comprising the thermo-plastic material is resistant to chemicals, corrosion, fire and moisture;

the outer frame comprising two or more sides that are fixed to each other, wherein each side is made of a contiguous piece of the printable rigid, thermo-plastic material having a front surface (f) and a back surface (b) opposite the front surface, wherein the back surface (b) has a first groove (g1) that permits the areas of the rigid material on each side of the first groove (g1) to fold 90° relative to each other to create a right angle for forming an outer side edge (e), the back surface (b) further comprising a second groove (g2) and a third groove (g3) that are adjacent to each other and located at a distance (d) from the first groove (g1), wherein the second groove (g2) and third groove (g3) permit the contiguous piece of printable rigid material to fold 180° such that the back surface (b) of the rigid material adjacent the second groove (g2) comes into contact with the rigid material adjacent the third groove (g3) to form an interior surface (i) of the outer frame assembly, wherein said grooves g1, g2, and g3 have a v-shape with an angle ranging from 80° to 95°, further comprising an outer back panel that is removably attached to the outer frame.

2. The frame assembly of claim 1, further comprising an inner back panel located between the outer frame and the outer back panel.

3. The frame assembly of claim 2, further comprising at least one additional material located between the outer frame and the inner back panel, the additional material selected from a transparent or translucent material comprising a glass or plastic plate, a mirror, a chalk-board, or a dry-erase whiteboard.

4. The frame assembly of claim 1, wherein the distance (d) defines the width of one side of the frame assembly.

5. The frame assembly of claim 1, wherein the outer frame comprises two or more sides attached to each other by at least one nail, screw, adhesive or combinations thereof.

6. The frame assembly of claim 5, wherein at least one nail is v-shaped.

7. The frame assembly of claim 1, wherein the thermo-plastic material comprises polyvinyl chloride (PVC).

8. The frame assembly of claim 7, wherein the polyvinyl chloride (PVC) is in the form of a multilayer material having a foamed PVC inner layer forming the back surface, and a smooth, rigid PVC layer forming the front surface.

9. The frame assembly of claim 8, wherein the back side comprises the foamed PVC layer and the front side comprises the smooth, hard PVC layer.

10. The frame assembly of claim 1, wherein the outer frame comprising four sides that are fixed to each other and form a rectangular shape.

11. The frame assembly of claim 1, wherein at least one of the front side or outer edge includes a printed image.

12. The frame assembly of claim 11, wherein the printed image further comprises at least one UV ink or UV clear coat.

13. The frame assembly of claim 1, further comprising a shadow-box integrally connected to the frame assembly.

14. The frame assembly of claim 13, wherein a transparent or translucent material is located between the frame assembly and the back panel, wherein the transparent or translucent material comprises a glass or plastic plate.

15. The frame assembly of claim 14, wherein the back panel removably attached to the shadowbox comprises one or more wall mounting holes for mounting the frame assembly and the shadow-box to a wall.

16. The frame assembly of claim 14, wherein the back panel removably attached to the frame assembly further comprises a magnetic strip for securing the back panel to the frame assembly.

17. The frame assembly of claim 13, wherein the shadowbox further comprises a light for illuminating the object displayed in the frame.

18. The frame assembly of claim 1, further comprising at least one fastener selected from a T-nut, turn button, thumb screw or combinations thereof.

19. The frame assembly of claim 18, wherein the thumb screw includes a magnetic head for removable attaching the frame assembly to a magnetic surface.

20. The frame assembly of claim 18, comprising two thumb screws and a wire attached to the thumb screws for hanging the frame assembly.

21. The frame assembly of claim 18, further comprising a pin or peg attached to a T-nut to form an easel to support the frame assembly.

22. A method of making a frame assembly, said method comprising:

providing a contiguous piece of printable, rigid, thermo-plastic material wherein the outer frame comprising the thermo-plastic material is resistant to chemicals, corrosion, fire and moisture and having a front surface (f) and a back surface (b) opposite the front surface;

forming one side of the frame assembly by machining multiple grooves into the back surface (b), wherein said machining provides:

a first groove (g1) that permits the areas of the rigid, thermo-plastic material on each side of the groove (g1) to fold 90° relative to each other to create a right angle and forming an outer side edge (e), two adjacent grooves (g2 and g3) located at a distance (d) from groove (g1), wherein grooves g2 and g3 permit the contiguous piece of printable rigid material to fold 180° such that backside of the printable rigid material on each side of g2 and g3 come into contact with each other to form an interior surface (i) of the outer frame assembly, wherein said grooves g1, g2, and g3 have a v-shape with an angle ranging from 80° to 95°;

repeating the forming steps to produce multiple sides of the frame; and fastening the multiple sides of the frame to produce an outer frame that defines an area in which the object is displayed, forming an outer back panel that is removably attached to the outer frame.

23. The method of claim 22, further comprising adhering the backside of the printable rigid material on each side of g2 and g3 that come into contact with each other by depositing an adhesive or using a chemical welding technique.

24. The method of claim 22, wherein fastening the sides of the outer frame comprises mitering each side at an angle sufficient to give the desired shape, followed by attaching each side with at least one screw, nail, or an adhesive.

25. The method of claim 22, wherein the outer frame comprises four side, and each side is mitered at an angle of 45° to give the outer frame a rectangular shape.

26. The method of claim 22, further comprising printing an image on the front and/or side walls by digital printing or screen printing.

* * * * *